US006886722B2

(12) United States Patent
Flecheux

(10) Patent No.: US 6,886,722 B2
(45) Date of Patent: May 3, 2005

(54) NON-SEPARABLE ATTACHMENT FOR DISPENSING DEVICE

(75) Inventor: Franck Flecheux, Bellegarde sur Valserine (FR)

(73) Assignee: Cebal Aerosol France, Chatillon en Michaille (FR)

( * ) Notice: Subject to any disclaimer, the term of this patent is extended or adjusted under 35 U.S.C. 154(b) by 0 days.

(21) Appl. No.: 10/829,455

(22) Filed: Apr. 22, 2004

(65) Prior Publication Data

US 2004/0232176 A1 Nov. 25, 2004

Related U.S. Application Data

(63) Continuation-in-part of application No. PCT/FR02/03790, filed on Nov. 6, 2002.

(51) Int. Cl.[7] ..... B65D 5/72
(52) U.S. Cl. ..... 222/570; 222/321.9
(58) Field of Search ..... 222/570, 321.9

(56) References Cited

U.S. PATENT DOCUMENTS

| | | | | |
|---|---|---|---|---|
| 6,244,472 | B1 | 6/2001 | Henneman | |
| 6,527,148 | B2 * | 3/2003 | de Rosa | 222/321.9 |
| 6,588,614 | B2 * | 7/2003 | Neuner | 222/570 |

FOREIGN PATENT DOCUMENTS

| | | |
|---|---|---|
| EP | 0549987 | 7/1993 |
| WO | 0138185 | 5/2001 |

* cited by examiner

*Primary Examiner*—Philippe Derakshani
(74) *Attorney, Agent, or Firm*—Dennison, Schultz, Dougherty & MacDonald

(57) ABSTRACT

Metal housing provided with a sidewall and a neck connected to the sidewall via a shoulder, the neck being constructed and arranged for irreversible fixation to a dispensing head for perfect leaktightness to liquids. The dispensing head includes a plastic flange provided with a sealing skirt and an outer catching skirt provided with a snap-fit rim on its inner surface, wherein the neck has a wall and the shoulder has a wall, both said walls being of substantially the same thickness as the sidewall.

7 Claims, 2 Drawing Sheets

NON-SEPARABLE ATTACHMENT FOR DISPENSING DEVICE

This application is a continuation-in-part of PCT/FR02/03790 filed Nov. 6, 2002, incorporated herein by reference.

BACKGROUND OF THE INVENTION

The invention relates to a substantially irreversible attachment system for a dispensing head on a metal housing, the assembly obtained having to be non-separable and leaktight. An assembly is qualified as being non-separable if a force exceeding about 15 daN is necessary to separate it.

The dispensing head may simply be a head for dispensing the product contained in the metal housing through a small diameter orifice (for example drop by drop dispensing head, dispensing head with end piece fitted with a cap, etc.). It may also be more complex, for example it may be provided with a ball dispenser or an atomizer. But regardless of what type of dispensing device is used, the head is characterized by the fact that it is made of plastic and comprises an outer catching skirt and an internal sealing skirt that are concentric with each other and attached to the same base.

Products to be stored and dispensed from this type of assembly include particularly food, cosmetics, pharmaceutical applications (dermatological, ophthalmic, etc.) and perfumes.

DESCRIPTION OF RELATED ART

For example, FR 2 762 589 (corresponding to U.S. Pat. No. 6,244,472) describes devices for dispensing fluid products comprising a head fixed onto a receptacle by means of a flange (reference 3 FR 2 762 589) provided with a sealing skirt and a cylindrical outer catching skirt, itself provided with a snap-fit rim to fix the head by simple force-fitting into the substantially cylindrical neck of a receptacle. In this special case described in FR 2 762 589, there is a housing above the flange in which a pump can be fitted (reference 4 in FR 2 762 589).

In practice, an attachment system like that described in FR 2 762 589 is suitable for glass flasks and plastic housings. FIG. 1 shows a glass flask 1 fitted with a flange 3 in which there is an orifice 8, for example through which the cylindrical body of a pump passes. Its neck 2 is provided with a shoulder 4 on its external wall that traps a rim 5 placed on the inner surface of the outer catching skirt 6 of the flange. The neck is trapped between the outer catching skirt and the sealing skirt 7. The dispensing device is thus kept firmly in place on the neck of the flask by means of the rim which, after the flange has been force-fitted onto the neck, is urged to be folded down on a diameter smaller than the diameter of the shoulder formed on the external wall of the neck.

It is easy to mold glass or plastic to form a shoulder on the external wall of the neck, but this is not the case with metallic receptacles. Metallic receptacles cannot be obtained by molding under economically satisfactory conditions. They are obtained either by assembling and crimping welded rolled parts with stamped end pieces, or by necking by stamping cylindrical blanks, themselves obtained by impact extrusion of slugs.

The open end of the metallic receptacle, die-pressed or stamped, may be in the form of a straight cylindrical or slightly tapered pipe, possibly provided with a curl at its If the shape of the neck is maintained in the form of a globally cylindrical straight pipe, a snap-fit groove can be made on the external wall which has a shape complementary to the shape of the snap-fit rim of the flange, but the flange is easily separated from the neck. Furthermore, since the thickness of the metal housing is less than the thickness of the glass flask or the plastic housing, the assembly obtained is not leaktight. Either a special flange has to be made, or flanges also used for glass and plastic receptacles need to be used with an elastomer O-ring. If an O-ring is used, as many dispensers envisaged within the context of this invention dispense a packaged product that is a product that will be used for pharmaceutical or food applications, many compatibility tests will have to be carried out with the elastomer chosen for the O-ring. Regardless of what solution is chosen, the assembly manufacturing cost will increase unacceptably.

However, metal packagings can be stronger, of lighter weight and less expensive than glass receptacles and provide a better barrier to diffusion of gases and aromas and a better barrier to light than plastic receptacles. Therefore, the applicant attempted to find a system for the attachment of a dispensing head on a metal housing making the assembly non-separable and leaktight, under economically satisfactory conditions, with the head being made of plastic, comprising a concentric outer catching skirt and internal sealing skirt, attached to the same base. Preferably, this head may be installed equally on glass, plastic or metal receptacles.

SUMMARY OF THE INVENTION

The invention is directed to a metal housing provided with a sidewall and a neck connected to the sidewall via a shoulder, the neck being designed to be irreversibly fixed to a dispensing head such that it is perfectly leaktight to liquids, the dispensing head comprising a plastic flange provided with a sealing skirt and an outer catching skirt itself provided with a snap-fit rim on its inner surface, characterized in that the thickness of the wall of the neck is substantially the same as the thickness of the wall of the shoulder and the sidewall and in that it comprises the following parts from its open end to its connection to the shoulder:

- an open end in the form of an orifice surrounded by an curl oriented outwards, the minimum inside diameter of the neck being equal to or slightly less than the outside diameter of the sealing skirt;
- a substantially tapered shoulder connecting the open end provided with the curl, to a first substantially cylindrical part;
- a first substantially cylindrical part; and
- a second substantially cylindrical part, for which the outside diameter is less than the outside diameter of the first substantially cylindrical part.

The first substantially cylindrical part and the second substantially cylindrical part are separated from each other by a shoulder, located at a distance from the open end such that when the flange has been fully force-fitted onto the neck, the snap-fit rim is urged to be folded down on a diameter smaller than the diameter of the first substantially cylindrical part.

The neck is thus trapped between the external skirt and the sealing skirt and the dispenser is held firmly in place on the neck of the housing by means of the rim which, after the flange has been force-fitted onto the neck, is urged to be folded down on a diameter smaller than the diameter of the shoulder formed on the wall of the neck.

In order to guide the dispensing head while force-fitting and thus to provide good prepositioning of the dispensing head on the neck of the receptacle before the head is forced onto the neck, the diameter of the end of the curl is close to the inside diameter of the external skirt of the flange.

However, this is preferably always smaller so as to limit the force necessary to force-fit the head onto the neck, and minimize the friction force acting on the external skirt, which gives better control of the snap-fit force. In the example presented below, this force must remain between 20 and 40 daN for penetration rates of the dispensing head onto the housing of up to 2000 mm/min.

The thickness of the neck wall is similar to the thickness of the remainder of the receptacle, which means that receptacles lighter than glass receptacles can be used. Despite the fact that the metal wall is thin, it has better mechanical characteristics than plastic receptacles. The metal used to make the housing may be either steel, or preferably an aluminum alloy. This type of geometry may be obtained by one or more die-pressing, die-stamping, fluoturning, spinning and/or knurling steps.

In the first step, a cylindrical pipe is made by necking the open end of a cylindrical blank obtained either by drawing and ironing (steel or aluminum alloy) or by impact extrusion (aluminum alloy). The outside diameter of this cylindrical pipe is equal to the outside diameter of the first substantially cylindrical part. This cylindrical pipe is then necked further to obtain the substantially tapered part and a new smaller diameter cylindrical pipe, starting from which the curl is made. The shoulder and the second substantially cylindrical part may for example be made by knurling. One or more rollers are applied onto the outside surface of the pipe. These rollers follow a planetary path around the pipe. This gives a shoulder with a sharp angle, in other words with a fillet radius less than 0.2 mm. In this way, snap-fitting—where the rim of the external skirt is trapped—is effective, and guarantees that the dispensing head cannot be removed easily (extraction force more than 15 daN).

Leaktightness is achieved by the inside of the curl coming into contact with the sealing skirt while the neck is trapped between the sealing skirt and the external skirt. Leaktightness to liquids is achieved and there is no need to install an elastomer O-ring.

The metal housing can be coated with a varnish on its inner wall. The different die-stamping and knurling passes described above help to shape the neck without damaging the varnish. The curl is rolled outwards, such that there is no contact between the liquid product and the bare edge of the housing wall. Therefore there is no risk of corrosion of the housing or, more generally, of any chemical reaction between the container and the contents.

DESCRIPTION OF THE PREFERRED EMBODIMENTS

Figure 1:
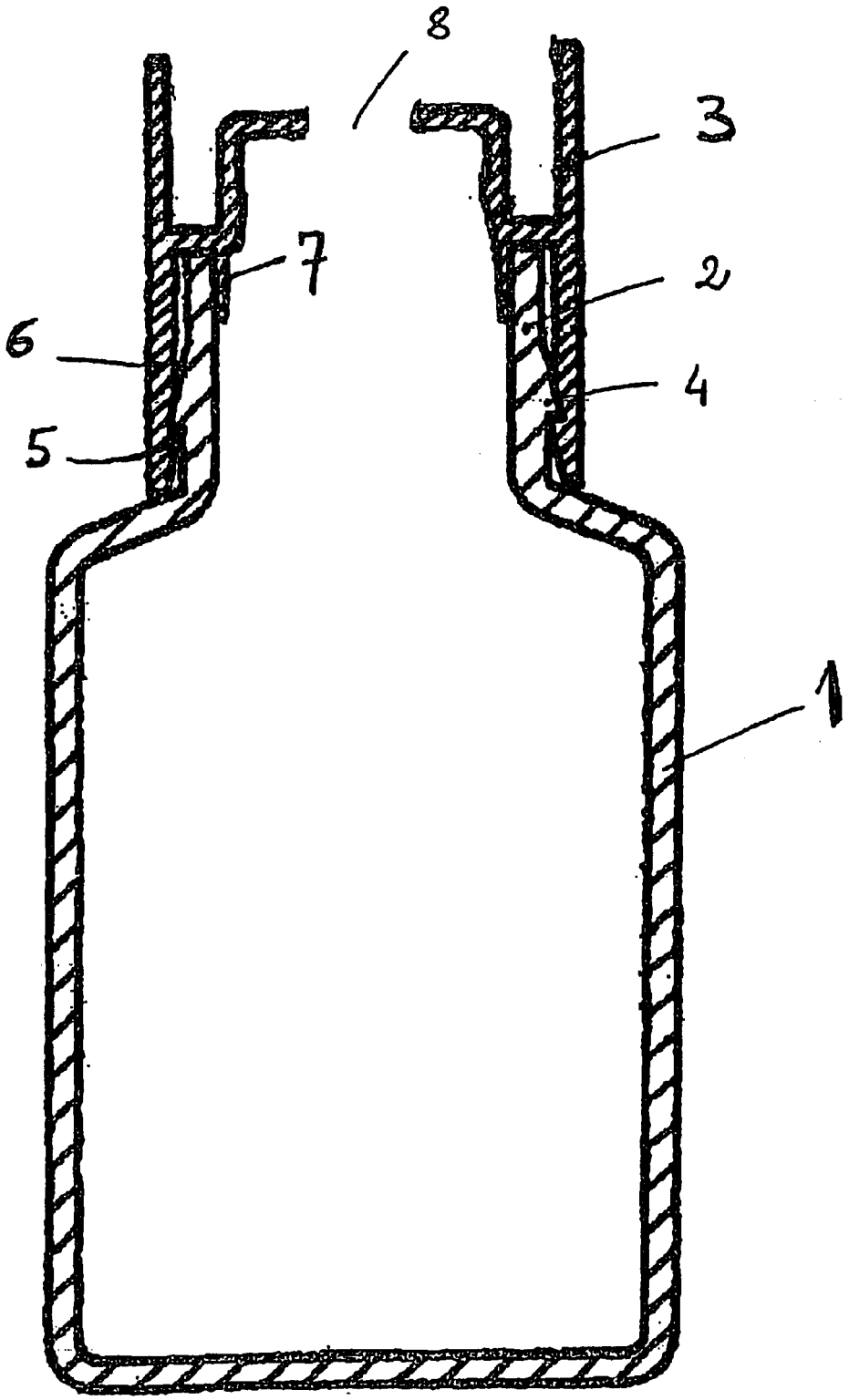
Fig. 1 Prior Art
FIG. 1 is a cross-sectional view of a prior art receptacle and its attachment flange as can be seen in FR 2 762 589. This type of receptacle cannot be obtained under economically satisfactory conditions unless it is made of glass or plastic.
Figure 2A:
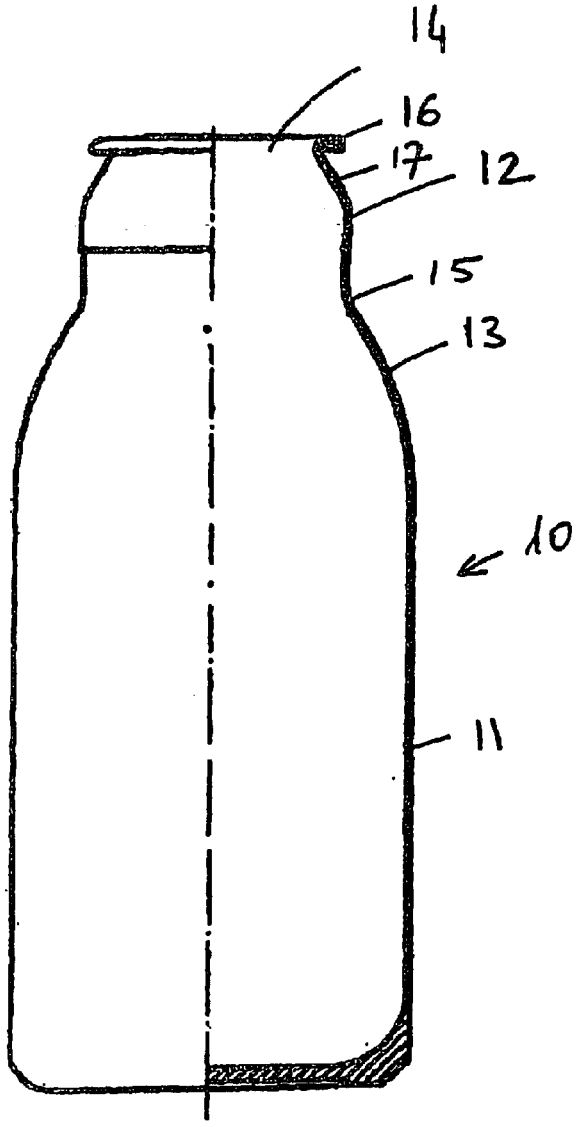
FIG. 2*a* shows a half-front view and a half-diametric section of a metal housing according to the invention.
Figure 2B:
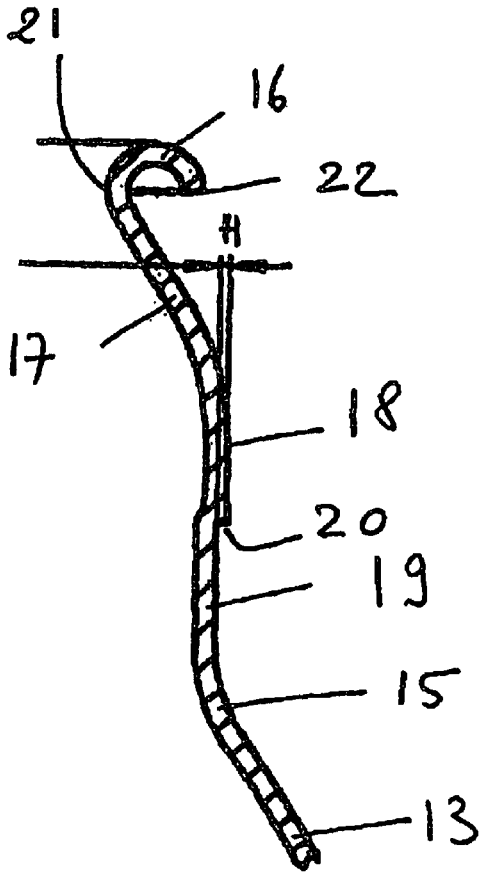
FIG. 2*b* shows an enlarged section through the housing at the neck.

FIG. 2 shows a housing according to the invention on which a flange like that illustrated in FIG. 1 will be fitted. In this special case, the housing is made of an aluminum alloy denoted 1050 according to the Aluminum Association designation.

The housing 10 is provided with a sidewall 11 and a neck 12 connected to the sidewall through a shoulder 13. The diameter of the sidewall is 23.6 mm. The neck will be irreversibly fixed to a dispensing head such that it is perfectly leaktight to liquids, the dispensing head comprising a plastic flange like that illustrated in FIG. 1 (reference 3). The neck 12 has a wall with a thickness of between 0.35 and 0.40 mm, substantially equal to the thickness of the shoulder 13 and the sidewall 11. It is provided with the following parts from its open end 14 to its connection 15 to the shoulder 13:

- an open end 14 in the form of an orifice surrounded by a curl 16. The minimum inside diameter of the neck (11.8 mm) is slightly less than the outside diameter of the sealing skirt 7 (12.2 mm);
- a substantially tapered shoulder 17 connecting the open end 14 provided with the curl 16 to a first substantially cylindrical part 18;
- a first substantially cylindrical part 18, for which the outside diameter (16 mm) is slightly greater than the outside diameter of the inside wall of the outer catching skirt 6 of the flange 3 (15.3 mm);
- a second substantially cylindrical part 19 for which the outside diameter (15.7 mm) is less than the diameter of the first substantially cylindrical part. The difference between these diameters is greater than two radial heights of the snap-fit rim (0.1 mm);
- the first substantially cylindrical part 18 and the second substantially cylindrical part 19 are separated from each other by a shoulder 20 located at a distance from the open end such that, when the flange 3 is fully force-fitted onto the neck 12, the snap-fit rim 5 is urged to be folded down on a diameter less than the diameter of the first substantially cylindrical part 18.

The neck 12 is thus trapped between the outer catching skirt 6 and the sealing skirt 7. The dispensing device is held firmly in place on the neck 12 of the housing thanks to the rim 5 which, after the flange 3 has been force-fitted onto the neck 12, is urged to be folded down on a diameter less than the diameter of the shoulder 20 formed on the wall of the neck.

The diameter of the end 22 of the curl 16 is equal to 15.1 mm, close to the inside diameter of the outer catching skirt 6 of the flange 3 (15.3 mm) but less than the inside diameter of the flange, so as to limit the force necessary to fit the head onto the neck by minimizing the friction force acting on the outer catching skirt 6, and to provide good guidance for the dispensing head during force-fitting and thus to give good prepositioning of the flange on the receptacle neck before the head is forced fitted onto the neck.

The housing is manufactured schematically as follows:

The first step is to make a cylindrical pipe by necking the open end of a 24 mm-diameter cylindrical blank obtained by impact extrusion of a 1050 aluminum alloy slug. This cylindrical pipe has an outside diameter of 16 mm, equal to the outside diameter of the first substantially cylindrical part 18. The cylindrical pipe is then necked further in order to obtain the substantially tapered part 17 and a new smaller diameter cylindrical pipe, that is used to make the curl 16. The shoulder 20 and the second substantially cylindrical part 19 are obtained by knurling.

With this geometry, the polypropylene flange is forced fitted with a snap-fitting force of between 20 and 40 daN, the penetration rate reaching 2000 mm/min. The tear out force after the assembly has been kept at 48° C. for seven days is still greater than 15 daN.

Leaktightness is achieved by contact between the inside 21 of the curl 16 in contact with the sealing skirt 7, whereas the neck 12 is trapped between the sealing skirt and the outer catching skirt 6. The leaktightness test consists of filling the housing 10 with colored alcohol, and providing it with a flange 3 without any orifice 8. The assembly is placed above a white cloth inside a chamber. A relative vacuum equal to 650 mm of mercury is created inside the chamber. It is observed that the white cloth was not stained after 24 hours in the vacuum chamber.

Similarly, leaktightness to gases is satisfactory: a maximum weight loss of 20 mg/d is observed after the assembly has been kept full of ethanol at the nominal volume for 7 days at 48° C.

This type of aluminum alloy housing is usually coated with a phenolic epoxy varnish or an organosol varnish on its inner surface. For accessibility reasons, the varnish is preferably deposited before the neck is shaped. The various steps described above for shaping the neck will not damage the varnish.

Since this metal housing is thin, it is also lightweight and has very good resistance to vertical compression, the limiting force being considerably greater than twice the maximum snap-fit force (80 daN).

Apart from non-separability and leaktightness of the assembly made as described above, the dispenser with its metallic housing has many advantages that cannot be obtained with glass or plastic receptacles; it is unbreakable and lightweight, and provides a perfect barrier to light and diffusion of gases and perfumes.

As shown in the example, the geometry of the neck of the housing made according to the invention can be adapted to standard flanges used elsewhere for glass or plastic receptacles.

What is claimed is:

1. Metal housing provided with a sidewall and a neck connected to the sidewall via a shoulder, the neck being constructed and arranged for irreversible fixation to a dispensing head for perfect leaktightness to liquids, the dispensing head comprising a plastic flange provided with a sealing skirt and an outer catching skirt provided with a snap-fit rim on its inner surface, wherein the neck has a wall and the shoulder has a wall, both said walls being of substantially the same thickness as the sidewall, said metal housing comprising:

an open end in the form of an orifice surrounded by a curl oriented outwards, the neck having a minimum inside diameter being equal to or slightly less than an outside diameter of the said sealing skirt;

a first substantially cylindrical part;

a substantially tapered shoulder connecting the open end on which the curl is formed to the first substantially cylindrical part; and a second substantially cylindrical part, having an outside diameter less than an outside diameter of the first substantially cylindrical part;

the first substantially cylindrical part and the said second substantially cylindrical part being separated from each other by a shoulder that is located at a distance from the open end such that when the said flange has been fully force-fitted onto the neck, the snap-fit rim is urged to be folded down on a diameter smaller than the diameter of the first substantially cylindrical part.

2. Metal housing (10) according to claim 1, wherein the diameter of the end of the curl is smaller than the inside diameter of the external skirt of the flange.

3. Metal housing according to claim 1, wherein said shoulder has a sharp angle, with a fillet radius less than 0.2 mm.

4. Metal housing according to claim 1, having an inner surface coated with a varnish.

5. Metal housing according to claim 1, wherein the first substantially cylindrical part has an outside diameter which is slightly greater than the outside diameter of the inner surface of the outer catching skirt of the flange.

6. Metal housing according to claim 1, wherein the difference in the diameter between the outside diameter of the second substantially cylindrical part and the outside diameter of the first substantially cylindrical part is greater than two radial heights of the snap-fit rim.

7. Dispensing housing comprising a metal receptacle according to claim 1 in combination with a dispensing head irreversibly fixed to the housing and thereby being perfectly leaktight to liquids, the dispensing head comprising a plastic flange provided with a sealing skirt and an outer catching skirt itself provided with a snap-fit rim on its inner surface.

* * * * *